US008122743B2

(12) United States Patent
Schulze

(10) Patent No.: US 8,122,743 B2
(45) Date of Patent: Feb. 28, 2012

(54) AUTOMATICALLY CONTROLLED WASHING MACHINE

(75) Inventor: Ingo Schulze, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 315 days.

(21) Appl. No.: 12/599,540

(22) PCT Filed: Apr. 30, 2008

(86) PCT No.: PCT/EP2008/055334

§ 371 (c)(1),
(2), (4) Date: Nov. 10, 2009

(87) PCT Pub. No.: WO2008/138762

PCT Pub. Date: Nov. 20, 2008

(65) Prior Publication Data

US 2010/0300157 A1 Dec. 2, 2010

(30) Foreign Application Priority Data

May 11, 2007 (DE) ..... 10 2007 022 098

(51) Int. Cl.
*D06F 39/02* (2006.01)

(52) U.S. Cl. ..... 68/17 R; 68/207

(58) Field of Classification Search ..... 68/17 R, 68/207

See application file for complete search history.

(56) References Cited

U.S. PATENT DOCUMENTS

| | | | | |
|---|---|---|---|---|
| 4,110,075 | A | 8/1978 | Graf et al. | |
| 5,562,987 | A | 10/1996 | Shimizu | |
| 6,826,933 | B2 * | 12/2004 | Merkle et al. | 68/17 R |
| 2005/0229652 | A1 | 10/2005 | Kim et al. | |
| 2007/0163307 | A1 | 7/2007 | Kramme et al. | |
| 2009/0095027 | A1 * | 4/2009 | Deppermann et al. | 68/12.02 |
| 2010/0095712 | A1 * | 4/2010 | Kim | 68/12.18 |

FOREIGN PATENT DOCUMENTS

| | | | |
|---|---|---|---|
| DE | 34 03 628 | * | 8/1985 |
| DE | 34 03 852 | * | 8/1985 |
| DE | 3403622 | A1 | 8/1985 |
| DE | 39 00 775 | * | 7/1989 |
| DE | 69019666 | T2 | 10/1995 |
| DE | 20115173 | U1 | 12/2001 |
| SU | 157901 | | 9/1963 |

OTHER PUBLICATIONS

European Patent Office 0 169 604 Jan. 1986.*
European Patent Office 1 085 118 Mar. 2001.*
Foreign Patent Office Report—RU, Mar. 2011.

* cited by examiner

*Primary Examiner* — Frankie L Stinson
(74) *Attorney, Agent, or Firm* — James E. Howard; Andre Pallapies

(57) ABSTRACT

An automatically controlled washing machine having a machine room in an upper part on a front side of the washing machine, wherein the washing machine includes a detergent dispensing unit, a drawer, and a portable storage container, all of which are arranged in the machine room. The drawer is accessible from the front side of the washing machine and has at least one compartment whose top is open for adding washing powder or washing liquid. A counter-latching device corresponds to an overridable latching device when the drawer is opened to fill the compartment with the washing powder or washing liquid. A receiving device receives a portable storage container behind the compartment of the drawer, wherein the storage container stores a liquid or gel-like washing aid. The washing machine also includes a dosage device to automatically dose the liquid and or gel-like washing aid.

7 Claims, 2 Drawing Sheets

AUTOMATICALLY CONTROLLED WASHING MACHINE

BACKGROUND OF THE INVENTION

The invention relates to an automatically controlled washing machine having a detergent dispensing unit arranged in the upper front side of the machine space, said detergent dispensing unit containing a drawer that is accessible from the front and has at least one compartment to allow a hand-measured addition of a portion of washing powder or washing liquid, having at least one storage container for liquid or gel-like washing aids which is mounted behind the compartments of the drawer in the upper machine space, and having one device each for the automatic dosing of each stored washing aid.

A washing machine of the aforesaid kind is known from DE 34 03 622 A1. Disposed therein in the retraction direction of a drawer behind motor-driven detergent compartments which are open at the top for filling with individual doses of washing powders or washing liquids and which can be flushed out from above by means of water jets, is a reservoir for liquid washing aids which has to be refilled after the reserve supply has been used up. For that purpose a filling opening is provided in the cover section of the reservoir. Each time the detergent drawer is moved into a position to allow filling of the compartments, a specific dose of the stored washing aid is conveyed by means of a mechanism mounted on the drawer and its housing from the reservoir into a dosing chamber, from where it can be transferred by means of water into the tub of the washing machine during execution of a subsequent wash program.

Although such a storage facility in itself means a considerable lightening of the customer's workload in terms of the replenishment of washing aids, the occasionally necessary refilling of the reservoir is tedious nonetheless, especially since the filling opening of the reservoir should not be arbitrarily large in size because of the risk of washing aid slopping over during the movement of the drawer. The difficulty of refilling might also lead more often to the spilling of washing aid, resulting in the latter coagulating or becoming encrusted on the drawer and then making the drawer stiff and difficult to move. Frequent cleaning of the known drawers is therefore essential. Swapping washing aids before the reservoir is completely emptied is also not possible.

DE 201 15 173 U1 discloses dispensing containers for a program-controlled dishwasher or washing machine which are provided with a machine-readable data medium, a barcode label for example. The dispensing containers can be installed in a designated receiving slot in the appliance, but no details are given on the precise position of the containers.

DE 25 54 592 discloses an automatic washing machine having active washing substance containers which are arranged in a replaceable manner in the machine housing. However, no further information is given concerning the precise arrangement.

BRIEF SUMMARY OF THE INVENTION

The object underlying the invention is therefore to equip a washing machine of the type cited in the introduction in such a way that the handling of washing aids in reserve quantities in conjunction with a detergent dispensing unit is made easier for the customer while the aforementioned disadvantages are avoided.

This object is achieved according to the invention in that a drawer has at least one device for receiving a portable container for a reserve supply of liquid or gel-like washing aid comprising a plurality of doses. A portable container of said type can simultaneously serve as a standardized transport container for commercially available washing aids. In this way the customer is freed from the need to handle and touch the washing aid directly. He/she can ensure provisioning in the simplest way by placing the purchased package unchanged in the receiving device. No risk of spillage, soiling, agglutination and subsequent necessity of cleaning inhibits the untroubled use of the washing machine according to the invention. Furthermore, a container that has already been deposited in the receiving device can also be removed again by the customer before it is completely empty and replaced by a container containing a different washing aid without any need for the customer to fear spillages in the process.

The preconditions for untroubled use of the invention are at their optimum if the device comprises a spatially designed frame which is embodied as a single-part component of the drawer in the retraction direction of the drawer behind the compartment or compartments and is matched in terms of its shape and size to the shape and size of the portable container.

It is useful for the handling of a detergent dispensing unit equipped according to the invention if the drawer has an overridable latching device which corresponds with a counter-latching device permanently fixed to the housing when the drawer is opened sufficiently wide for filling the open-topped compartments. In that case, in order to fill the compartments with hand-measured portions of detergent at regular intervals, the drawer is pulled open only as far as the latching position such that the rear part of the drawer with the—heavy, if the reserve quantity is still large—receiving frame remains in the drawer guide. For the less frequent replacement of the washing aid package the drawer can be opened wider, beyond the overridable latching position.

Advantageously, a coupling device is arranged inside the form of the frame for the purpose of connecting the interior space of the container with an input opening of the dosing device. This means that the customer is not required to establish a coupling manually between the reserve supply package and the dosing system contained in the washing machine. The coupling is established automatically already at the time the container is inserted.

In order to represent an automatic coupling of said kind the coupling device can consist for example of a tubular plug and a tubular socket which are matched to each other in terms of their shape and size and of which one part (e.g. the socket) is a component of the container and the other part (e.g. the tubular plug) is a component of the frame and the two parts are positioned relative to each other in such a way that when the container is inserted in the correct manner both parts are coupled.

A solution that is even easier to implement for suppliers of packages for washing aids can consist in the coupling device being composed of a tubular needle which, when the container is inserted, pierces the wall of the latter at a specific point that is suitable for penetration by the tubular needle. In order to maintain the replaceability of such detergent packages, however, an additional measure to prevent a spilling of remaining detergent of a package that is not completely used up would be of advantage. Such a measure could consist in the point of penetration being sealed automatically by means of a suitable device when the tubular needle is withdrawn.

A development of the invention is advantageous wherein the drawer has a fill level sensor disposed near to the inserted portable container. The packages could in fact consist of transparent or translucent material so that the fill level can be checked with the naked eye. A fill level sensor is, however, absolutely essential in order to prepare for an automatic monitoring of the fill level and where appropriate also for an automatic intervention in the control of the wash program.

A more extensive automation of the control function is possible by means of a particularly advantageous development of the invention whereby the detergent dispensing unit is equipped with an automatic recognition device for optical, magnetic and/or electronic identification markers which are attached to the containers. Such markers are helpful and already in common use in any case for simplifying handling in the retail sector. The machine controller can also make use of this if the information content of the markers can also provide information with regard to process-relevant properties of the washing aid transported in the package.

BRIEF DESCRIPTION OF THE DRAWINGS

The invention is explained in more detail with reference to an exemplary embodiment illustrated in the drawing, in which.

DETAILED DESCRIPTION OF EXEMPLARY EMBODIMENTS OF THE PRESENT INVENTION

Figure 1:
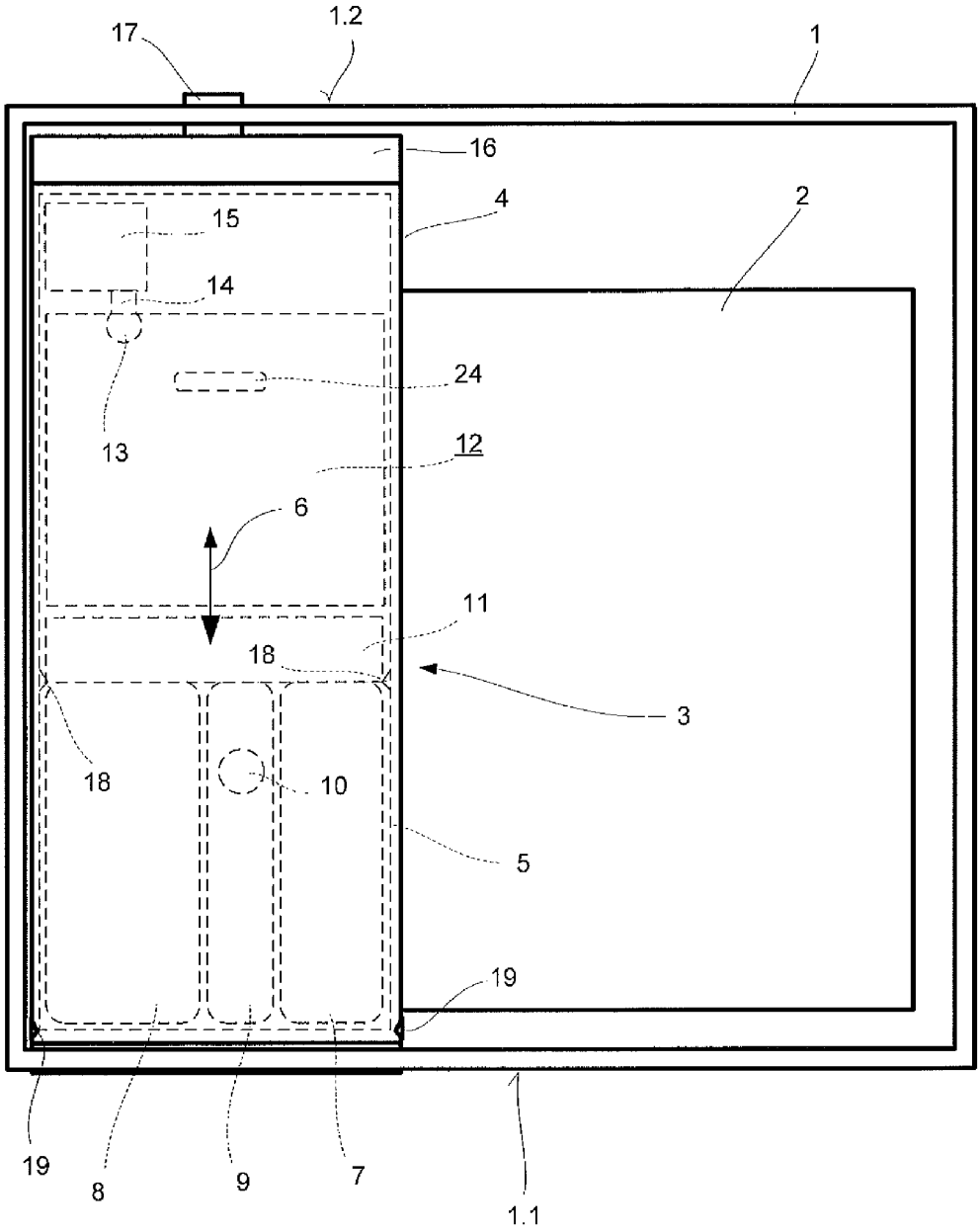
FIG. 1 shows a washing machine in a view from above having a detergent dispensing unit equipped according to the invention.

The housing 1 of the washing machine encloses a tub 2 which extends so far upward in the housing that only the upper laterally remaining space within the housing 1 is available for the detergent dispensing unit 3. The detergent dispensing unit 3 has its own housing box 4 which extends from the front panel 1.1 of the housing 1 to its rear wall 1.2 and in which the drawer 5 is guided in a freely movable manner in the direction of the arrow 6. The drawer 5 has three open-topped detergent compartments 7, 8 and 9 for prewash agent (7), main wash agent (8) and fabric conditioner (9). The fabric conditioner compartment 9 also has a siphon 10 (shown schematically). The rear ends of the compartments 7 and 8 and the siphon 10 lead into a discharge chute 11 which conveys the mixtures of washing aid and water which can be ducted from above into the compartments to the tub 2 in a manner not shown. Integrated in the drawer 5 behind the chute 11 there is at least one three-dimensional frame 12.1, 12.2, 12.3 and 12.4 with a depth approximately corresponding to that of the drawer in the form of a receiving space 12 for portable storage containers (package, tank, cartridge, magazine) for liquid or gel-like washing aids. The receiving space 12 is matched in terms of its shape and size to the respective package (20, FIG. 2) for a washing aid that is to be stored in reserve. When a single package is accommodated in the receiving space 12 of the drawer 5, a volume of 250 to 500 ml of washing aid can be stored. From this, concentrated washing aids can already serve to load up to fifteen wash programs that are to be run using just said washing aid stored in reserve.

At its base the receiving space has a part 13 of a coupling device, e.g. a tubular coupling plug, which is connected to the input opening 14 of a dosing device 15 which is likewise arranged in the drawer, in the rear part of the drawer 5 to be exact. When a plurality of packages are accommodated it is of course necessary to provide a corresponding number of dosing devices. The design of such dosing devices is not presented in any more detail. It can be embodied either in accordance with the prior art disclosed in DE 34 03 622 A1 or in a different manner by means of conveying devices (solenoid valve, pump, closing slider) either in a non-pressurized manner or in a pressurized manner.

A solenoid valve module 16 for loading the compartments 7 to 9 and where applicable the dosing device(s) 15 can additionally be arranged in the rear area of the housing box 4. Said module is supplied with fresh water from a domestic water supply (not shown) via a central inlet 17.

At the level of the rear ends of the compartments 7 to 9, the drawer 5 has laterally arranged latching notches 18 which slide along the guides in the housing box 4 in the direction of the double arrow 6 during the movement of the drawer 5. As soon as the drawer 5 has been retracted toward the front so far out of the housing box 4 that the openings of the compartments 7 to 9 are exposed, latching lugs 19 mounted laterally on the guides of the housing box 4 engage in the latching notches 18 and give the customer the signal to stop applying the pulling force. In this position the compartments can be filled by hand with the corresponding washing aids. In order to move the drawer 5 further either completely out of the housing box 4 or back into the housing box 4, the customer can override this latching position, and the latching elements are disengaged once more. The latching notches 18 and latching lugs 19 shown are to be understood only as a schematic implementation. Elements based on a different action can also be employed instead of said latching elements.

Figure 2:
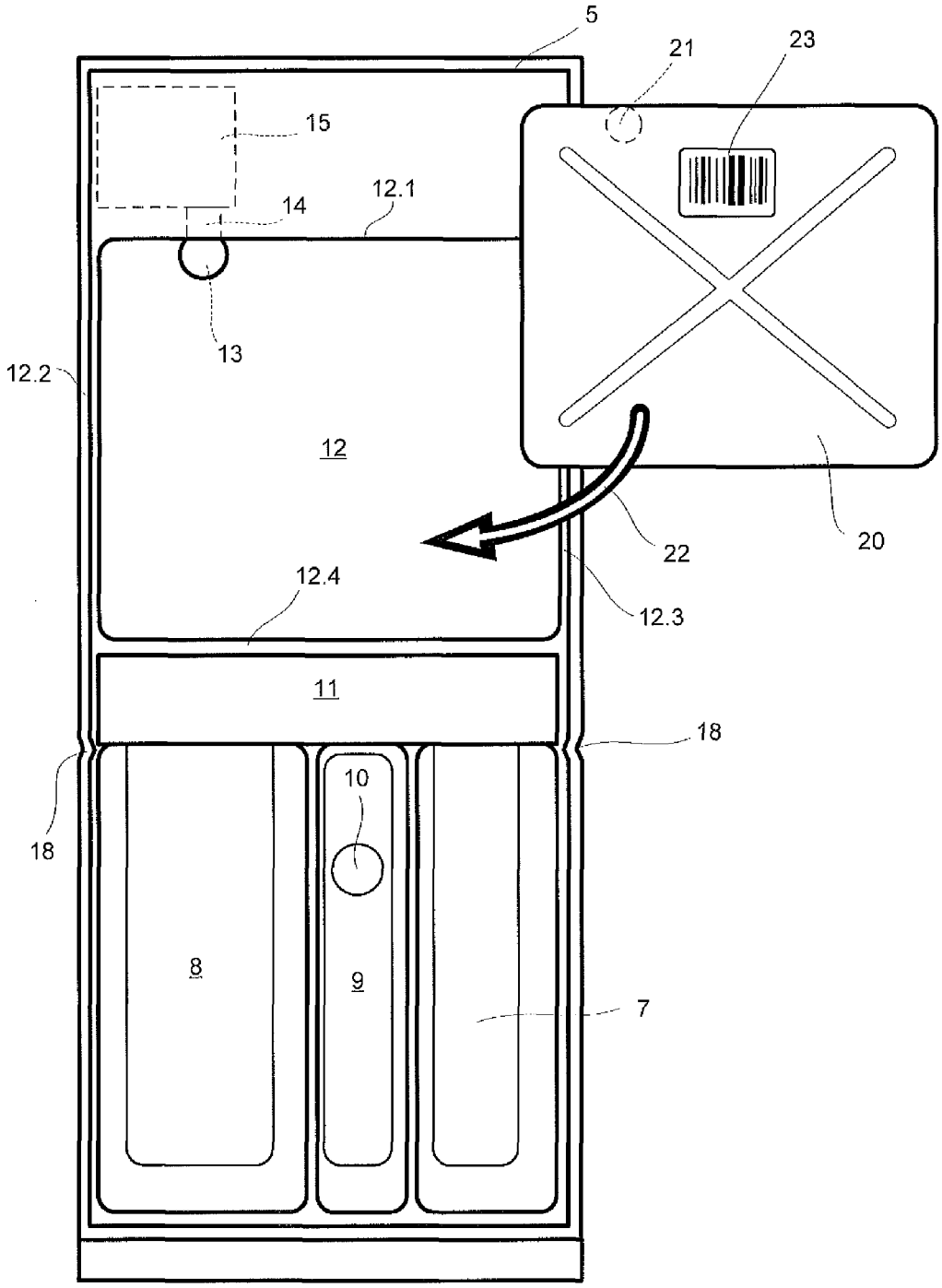
FIG. 2 shows a drawer for a detergent dispensing unit equipped according to the invention, the drawer comprising a transport container for washing aids.

The drawer 5 according to FIG. 2, completely removed from the housing box 4, shows in particular the insertion (arrow 22) of a washing aid package 20 into the receiving space 12. It can be seen therein that on its base, at a position corresponding to the tubular plug 13, the package 20 has the complementary part of the coupling device, more specifically a socket 21 which automatically couples with the tubular plug 13 of the receiving space 12 when the package 20 is correctly inserted.

In a manner not shown, a coupling device as described hereintofore can also be replaced by a tubular needle directed against the direction of movement of the package 20, e.g. at the base of the receiving space 12 at the same position as the plug 13 or at a different position, which tubular needle automatically pierces the base wall of the package 20 when the package 20 is correctly inserted and thereby establishes the connection between the interior space of the package 20 and the input opening 14 of the dosing device 15. The washing aid liquid or gel can be conveyed out of the package 20 into the dosing device 15 through the tube of the tubular needle or the plug 13.

On its top side at a specific position the package 20 bears an identification marker 23, in this instance in the form of an adhesive barcode label. As a prerequisite, the coding includes information about the composition, instructions for use and the like of the washing aid contained in the package 20. On the underside of the cover of the housing box 4, exactly over the identification marker 23 of the package 20 which is fully inserted into the housing box 4 together with the drawer 5, there is disposed a reading device 24 of an automatic recognition device for the adhesive barcode label so that the information contained in the coding can be read out and transferred to an evaluation device of a control device (all not shown) of the washing machine. This information can be analyzed in order to adjust the control of the washing machine.

Instead of the optical transmission of information presented hereintofore it is also possible to use a system that is based on a different optical and/or magnetic and/or electronic transmission technology. Transponders, for example, are particularly well suited for the automatic transmission of information.

In order to monitor the fill level of the washing aid inside the inserted package 20 a sensor device 25 can be used which—whatever form it takes—is mounted on the drawer 5 and/or on the housing box 4 and connected to the control device (not shown). In addition to the automatic signaling of a low fill level of the package 20 to the customer, the low fill level can also initiate an automatic adjustment to the program, namely, for example, not to trigger an output of portions of washing aid from the dosing device 15.

The invention claimed is:

1. An automatically controlled washing machine having a machine room in an upper part on a front side of the washing machine, the washing machine comprising:

a housing;

a detergent dispensing unit arranged in the machine room;

a drawer arranged in the machine room and accessible from the front side of the washing machine, the drawer having at least one compartment whose top is open to allow for hand-dosed addition of one of a washing powder portion and a washing liquid portion;

an overridable latching device attached to the drawer;

a counter-latching device attached to the housing and to correspond to the latching device when the drawer is opened by a predetermined distance to fill the compartment with the one of the washing powder portion and the washing liquid portion;

at least one portable storage container arranged in the machine room behind the compartment of the drawer, the portable storage container to store a supply of a plurality of doses of one of a liquid washing aid and a gel-like washing aid;

at least one receiving device arranged in the drawer to receive the portable storage container; and a dosage device to automatically dose the stored supply of the one of the liquid washing aid and the gel-like washing aid.

2. The washing machine of claim 1, wherein the receiving device comprises a three-dimensional frame arranged, in retraction direction of the drawer, behind the compartment of the drawer and designed as an integral part of the drawer and whose shape and size matches the shape and size of the portable storage container.

3. The washing machine of claim 2, further comprising a coupling device arranged within the form of the frame and wherein the dosage device has an inlet opening, the coupling device to connect an interior space of the portable storage container to the inlet opening of the dosage device.

4. The washing machine of claim 3, wherein the coupling device comprises a tubular plug and a tubular socket; wherein the shape and size of the tubular plug matches the shape and size of the tubular socket; wherein one of the tubular plug and the tubular socket is part of the portable storage container and the other one of the tubular plug and the tubular socket is part of the frame; and wherein the tubular plug and the tubular socket are positively oriented in relation to each other so that the tubular plug is coupled to the tubular socket when the portable storage container is properly inserted into the receiving device.

5. The washing machine of claim 3, wherein the coupling device comprises a tubular needle to penetrate a wall of the portable storage container at a predetermined point suitable for piercing the wall when the portable storage container is inserted in the receiving device.

6. The washing machine of claim 1, wherein the drawer comprises a fill level sensor disposed at a predetermined proximity of the portable storage container inserted in the receiving device.

7. The washing machine of claim 1, wherein the detergent dispensing unit comprises an automatic recognition device for at least one of an optical, magnetic and electronic identification marker attached to the portable storage container.

* * * * *